US008950496B2

(12) United States Patent
Kitzman

(10) Patent No.: US 8,950,496 B2
(45) Date of Patent: Feb. 10, 2015

(54) COUNTER DEVICE FOR SELECTIVELY CATCHING PLUGS

(75) Inventor: Jeffery D. Kitzman, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 589 days.

(21) Appl. No.: 13/353,564

(22) Filed: Jan. 19, 2012

(65) Prior Publication Data

US 2013/0186633 A1 Jul. 25, 2013

(51) Int. Cl.
*E21B 34/06* (2006.01)

(52) U.S. Cl.
USPC ..... 166/318; 166/373; 166/64

(58) Field of Classification Search
USPC ..... 166/318, 319, 250.04, 373, 386, 64, 66, 166/102, 332.5
See application file for complete search history.

(56) References Cited

U.S. PATENT DOCUMENTS

| | | | | |
|---|---|---|---|---|
| 6,173,795 | B1 * | 1/2001 | McGarian et al. | 175/231 |
| 6,513,595 | B1 | 2/2003 | Freiheit et al. | |
| 7,556,102 | B2 * | 7/2009 | Gomez | 166/373 |
| 8,365,832 | B2 * | 2/2013 | Martin et al. | 166/374 |
| 8,479,823 | B2 * | 7/2013 | Mireles | 166/332.2 |
| 2009/0308588 | A1 | 12/2009 | Howell et al. | |
| 2010/0057103 | A1 * | 3/2010 | Sorrentino et al. | 606/143 |
| 2010/0252276 | A1 | 10/2010 | Clausen et al. | |
| 2011/0180270 | A1 | 7/2011 | Martin et al. | |
| 2011/0278017 | A1 * | 11/2011 | Themig et al. | 166/373 |
| 2012/0085542 | A1 * | 4/2012 | Hayter et al. | 166/332.4 |
| 2013/0118732 | A1 * | 5/2013 | Chauffe et al. | 166/250.04 |
| 2013/0186633 | A1 * | 7/2013 | Kitzman | 166/318 |
| 2013/0220603 | A1 * | 8/2013 | Robison et al. | 166/250.04 |
| 2013/0264049 | A1 * | 10/2013 | Mireles | 166/64 |
| 2013/0299199 | A1 * | 11/2013 | Naedler et al. | 166/386 |

FOREIGN PATENT DOCUMENTS

| | | | |
|---|---|---|---|
| EP | 0480584 | A2 | 4/1992 |
| WO | 2006120466 | A2 | 11/2006 |

OTHER PUBLICATIONS

Baker Hughes, [online]; [retrieved on Apr. 4, 2012]; retrieved from the internet http://www.bakerhughes.com/assets/media/brochures/4ea84301fa7e1c1e66000023/file/33832-fracpointmpsleeve_ovrw_hires.pdf.pdf%26fs=2065536, "FracPoint MP Sleeve with DirectConnect Ports", Baker Hughes Incorporated, 2011, 2p.

International Search Report and Written Opinion, Date of Mailing Apr. 12, 2013; International application No. PCT/US2012/071739, Korean Intellectual Prooperty Office; Written Opinion 4 pages; Intrnational search Report 7 pages.

* cited by examiner

*Primary Examiner* — Daniel P Stephenson
(74) *Attorney, Agent, or Firm* — Cantor Colburn LLP

(57) ABSTRACT

A counter assembly including an actuatable component. A counter component is disposed with the actuatable component and initially in a first position relative the actuatable component and movable with respect to the actuatable component. A lock member is engaged in a track formed between the actuatable component and the counter component. The lock member is operatively arranged for enabling relative movement between the actuatable component and the lock member in a first direction only and between the counter component and the lock member in a second direction only. At least one iteration of travel of the counter component to a second position relative the actuatable component and back to the first position progresses the lock member incrementally along the track. The actuatable component is immovably locked to the counter component by the lock member when the lock member has reached an end of the track.

23 Claims, 3 Drawing Sheets

COUNTER DEVICE FOR SELECTIVELY CATCHING PLUGS

BACKGROUND

It has recently become a subject of interest in the downhole drilling and completions industry to utilize a single sized plugging implement, e.g., ball, dart, etc., in order to actuate multiple tools. For example, multiple sleeves can be shifted by a single size of ball for opening ports in a fracturing operation, such as disclosed in United States Patent Publication No. 2009/0308588 (Howell et al.), which Publication is hereby incorporated by reference in its entirety. Such systems may include a counter mechanism for selectively enabling and restricting passage of a plug depending on a number of plugs that have been counted as passing by. While these known systems are generally adequate for their intended purposes, the industry always well receives advances and alternatives.

SUMMARY

A counter assembly including an actuatable component, a counter component disposed with the actuatable component and initially in a first position relative the actuatable component and movable with respect to the actuatable component, and a lock member engaged in a track formed between the actuatable component and the counter component, the lock member operatively arranged for enabling relative movement between the actuatable component and the lock member in a first direction only and between the counter component and the lock member in a second direction only, the first direction differing from the second direction, at least one iteration of travel of the counter component to a second position relative the actuatable component and back to the first position progressing the lock member incrementally along the track, wherein the actuatable component is immovably locked to the counter component by the lock member when the lock member has reached an end of the track.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
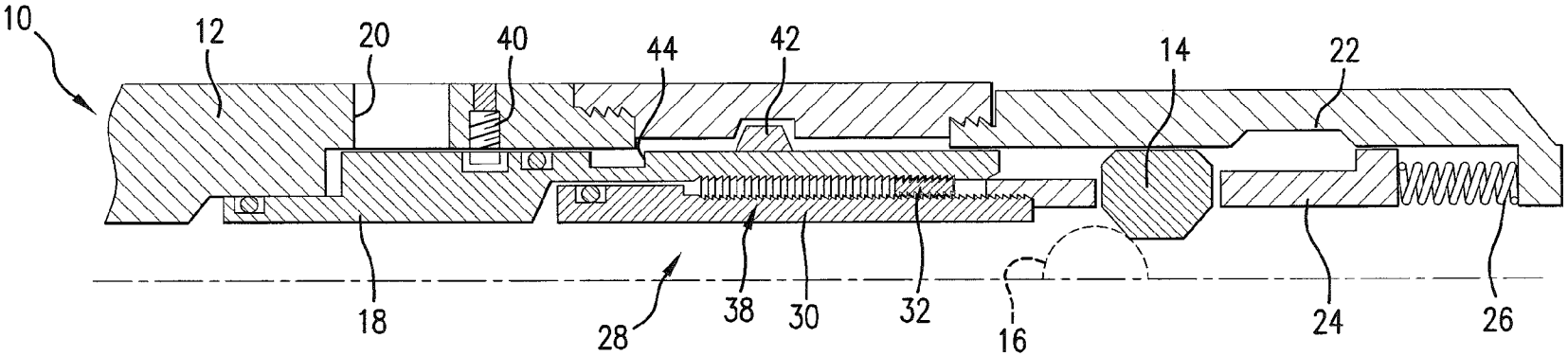
FIG. 1 is a quarter-sectional view of a pass-through actuation assembly in an initial position.
Figure 2:
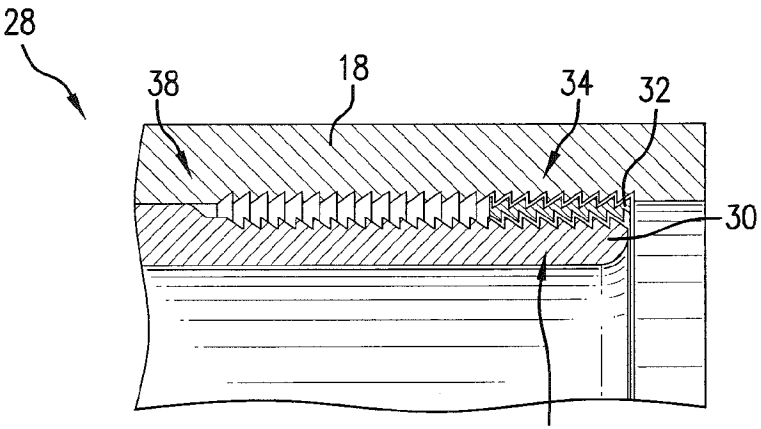
FIG. 2-6 show various positions of a counter mechanism as it counts a number of plugs passing through the assembly of FIG. 1.
Figure 3:
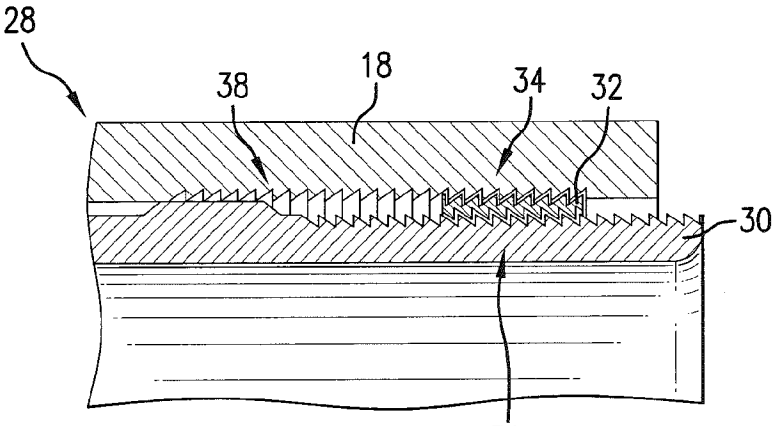

Referring now to FIG. 1, an actuation assembly 10 is shown disposed with a tubular 12. The assembly 10 includes a seat

14 that is engageable with a plug 16 for blocking fluid flow through the seat 14 and enabling a pressure event in the tubular 12 to actuate one or more tools. The plug 16 could be any suitable plugging implement, such as a ball, dart, etc. In the illustrated embodiment, the actuatable tool takes the form of a sleeve 18 that is shiftable for opening one or more ports 20 in the tubular 12. Advantageously, any number of the assemblies 10 can be included along the length of the tubular 12 for actuating multiple tools with a single sized plug, as will be better appreciated in light of the Figures and description below.

The seat 14 is arranged such that when engaged with the plug 16, suitable fluid pressure will shift the seat 14 toward a recess or groove 22. When axially aligned with the groove 22, the seat 14 becomes radially unsupported, thereby deforming, enlarging, shifting, or moving into the groove 22 in response to the pressure applied to the plug 16. For example, the seat 14 could take the form of a plurality of dogs or segments, a collet, a split ring, a c-ring, an elastically deformable ring, etc. For example, in the embodiment of FIG. 1, the seat 14 is disposed as dogs in windows of a mandrel 24. Under a suitable pressure, the plug 16 will be forced through the seat 14 and can continue to a seat (e.g., resembling the seat 14) of a subsequently positioned assembly (e.g., resembling the assembly 10) in the tubular 12 for actuating another tool (e.g., resembling the sleeve 18), as discussed in more detail below.

After the plug 16 has passed through the seat 14, the seat 14 is arranged to return to its original configuration. For example, in the illustrated embodiment, a spring 26 is arranged between the mandrel and a shoulder of the tubular 12 for urging the seat 14, via its engagement with the mandrel 24, away from the groove 22 and back into the configuration shown in FIG. 1. The spring 26 could take the form of any other biasing element for urging the seat 14 back to its initial position (FIG. 1) after passage of the plug 16 relieves the pressure acting on the seat 14.

A counter mechanism 28 is included in order to monitor the number of times the seat 14 is displaced by the plugs 16, which also correlates to the number of plugs 16 that pass through the seat 14. The counter mechanism 28 includes a counter sleeve 30 that is slideable with respect to the sleeve 18, but secured to or formed with the mandrel 24. A lock member 32 of the counter mechanism 28 is disposed between the sleeve 30 and the sleeve 18.

As shown in more detail in FIGS. 2-6, the lock member 32 is formed with ratchet profiles on both radial surfaces for engagement with the sleeves 18 and 30. Specifically, a first ratchet engagement 34 is formed between the lock member 32 and the sleeve 18. The engagement 34 enables relative movement of the lock member 32 with respect to the sleeve 18 in a first axial direction only, namely, to the left with respect to the orientation of FIGS. 2-6. A second ratchet engagement 36 is oppositely formed between the lock member 32 and the sleeve 30. The second ratchet engagement 36 enables relative movement of the lock member 32 with respect to the sleeve 30 in a second axial direction only, with the second direction being opposite from the aforementioned first direction, namely, to the right according to the orientation of FIGS. 2-6. It will be appreciated that other pairs of differing directions could work as well. As will be better appreciated in view of the below, the engagements 34 and 36 essentially form a track 38 along which the lock member 32 will incrementally travel for counting the number of plugs that pass through the assembly 10. The ratchet engagements 34 and 36 could be formed in the lock member 32 and the sleeves 18 and 30 as grooves, threads, etc. The lock member 32 could be or comprise a full ring, a c-ring, a plurality of discrete portions spaced from each other at different rotational locations, etc.

For the purposes of discussion only, the directions "left" and "right" may be used in describing the operation of the counter mechanism 28, although it is to be understood that these directions are given with respect to the orientation of FIGS. 2-6 only and could take the form of any pair of differing directions depending on the borehole in which the assembly 10 is utilized, e.g., horizontal, vertical, deviated, etc. It is to likewise be understood that with respect to the arrangement of the assembly 10 as shown throughout the Figures, movement to the right corresponds to moving further down-hole, while movement to the left corresponds to moving up-hole.

As discussed above, landing the plug 16 on the seat 14 and pressuring up will cause the seat 14 and the mandrel 24 to shift until the seat 14 becomes aligned with the groove 22 and the plug 16 passes thereby. During this process, the sleeve 30, which is immovable with respect to the mandrel 24, is also shifted, thereby altering the counter mechanism 28 from its initial arrangement in FIGS. 1 and 2 to the arrangement of FIG. 3 in which the sleeve 30 is shifted downhole, i.e., to the right. Due to the relative movement enabled in this direction between the lock member 32 and the sleeve 30 by the engagement 36, and the relative movement between the lock member 32 and the sleeve 18 prevented by the engagement 34, movement of the sleeve 30 downhole results in the lock member 32 remaining stationary relative to the sleeve 18, while shifting up-hole, i.e., to the left, relative to the sleeve 30.

Figure 4:
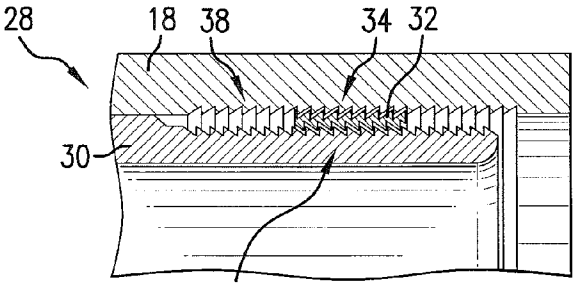

After passage of the plug 16 through the seat 14, the spring 26 urges the seat 14 back to its initial position, as described above. The urging by the spring 26 additionally moves the sleeve 30 back up-hole to its initial position relative to the sleeve 18 as shown in FIG. 4. The engagement 36 enables the sleeve 30 to "grab" the lock member 32 and carry the lock member 32 up-hole as the sleeve 30 travels back to its initial position. Due to the relative movement permitted in this direction by the engagement 34, the lock member 32 is moved relative to the sleeve 18. Thus, at the end of one cycle or iteration of a plug passing through the seat 14, the sleeves 18 and 30 are both in positions resembling their initial positions while the lock member 32 has traveled one "unit" up the track 38 defined by the engagements 34 and 36.

Figure 5:
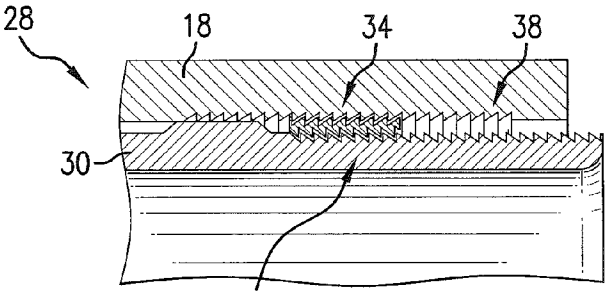
Figure 6:
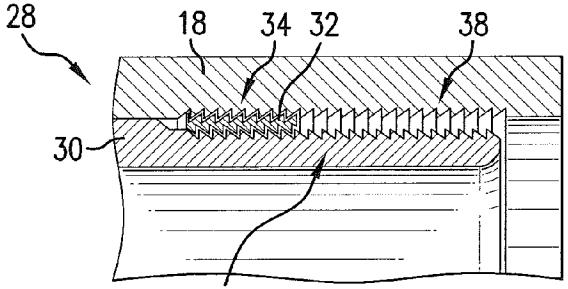

As can be appreciated in view of the distance traveled by the lock member 32 after one iteration of passing a plug, the track 38 of the assembly 10 shown in FIGS. 2-6 is arranged to enable the passage of two plugs before the lock member 32 reaches the end of the track 38. Of course, the mechanism 28 could be arranged to count the passage of any other required number of plugs. The sleeve 18 becomes actuatable once the plug 16 reaches the end of the track 38. That is, the above process is repeated by landing a second plug at the seat 14, pressuring up to cause the seat 14, and therefore the sleeve 30, to shift downhole as shown in FIG. 5. After passage of the second plug the spring 26 again returns the sleeve 30 to its initial position, with the sleeve 30 grabbing the lock member 32 and carrying the lock member 32 another "unit" along the track 38 as shown in FIG. 6. Once at the end of the track 38, as depicted in FIG. 6, relative movement between the lock member 32 and the sleeves 18 and 30 is no longer permitted in either axial direction. Alternatively stated, the lock member 32 becomes immovably locked to both the sleeves 18 and 30, thereby also immovably locking the sleeves 18 and 30 together via the lock member 32 in both axial directions. Thereafter, landing a third plug at the seat 14 and pressuring up in the tubular 12 will urge each of the seat 14, the mandrel 24, the sleeve 30, the lock member 32, and the sleeve 18 in the downhole direction.

Figure 7:
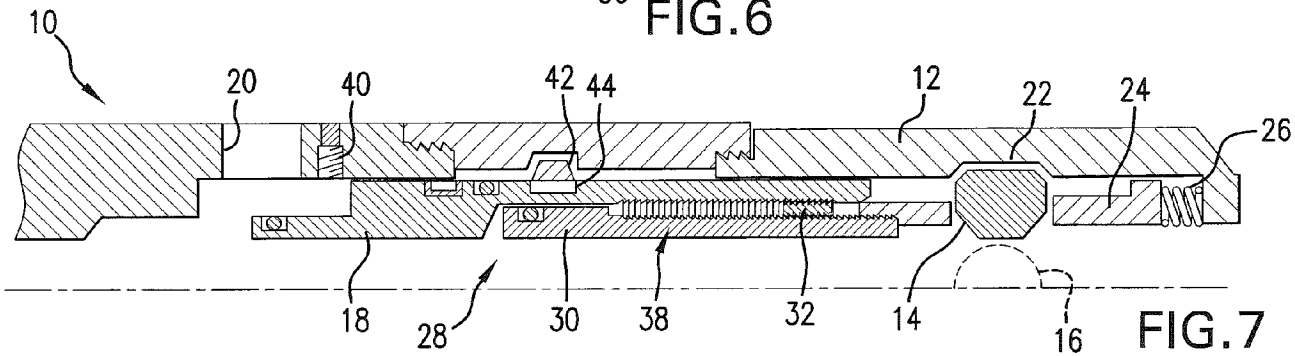
FIG. 7 is a quarter-sectional view of the assembly of FIG. 1 in an actuated position.

The sleeve 18 can be held in its initial position by a release member 40, taking the form of a shear screw in the illustrated embodiment, but which could alternatively be a collet, shear ring, spring or biasing element, etc. When the pressure in the tubular 12 exceeds the threshold of the release member 40, the release member 40 will release, enabling actuation of the sleeve 18, e.g., for opening the one or more ports 20 or performing some other operation. The actuated position of the sleeve 18 of the assembly 10 is shown in FIG. 7. In the illustrated embodiment a lock element 42 is provided with the tubular 12 for engaging into a recess or groove 44 of the sleeve 18 when movement of the sleeve 18 aligns the lock element 42 and the groove 44. For example, the lock element 42 could be a pre-tensioned c-ring or the like that snaps partially into the groove 44 to form an interference between the tubular 12 and the sleeve 18 for locking those components together. In this way, the ports 20 remain open even after pressure is relieved.

Figure 8:
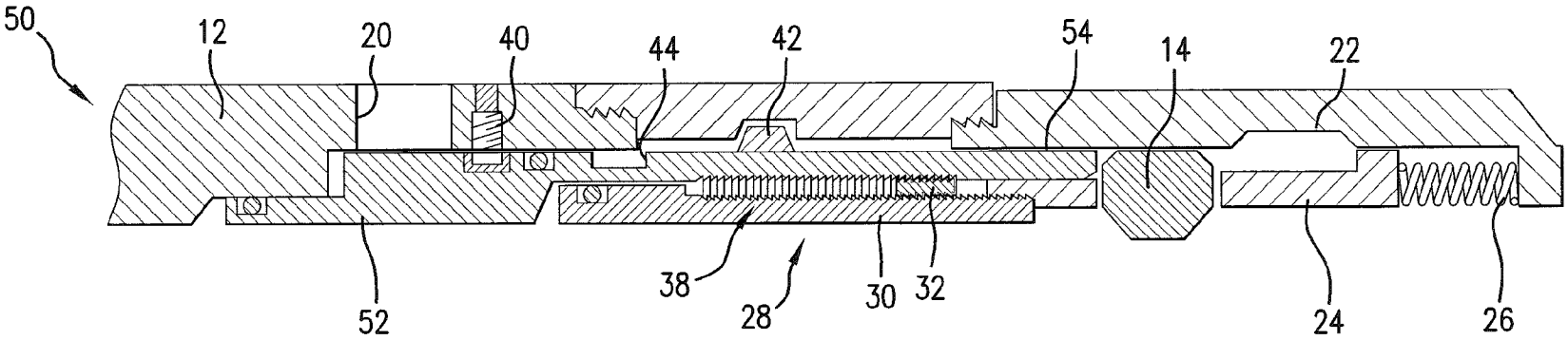
FIG. 8 is a quarter-sectional view of a plug-catch assembly.

It is to be appreciated in view of FIG. 7 that the assembly 10 is arranged as a pass-through assembly. That is, after movement of the sleeve 18, the seat 24 is aligned with the groove 22 for enabling any number of plugs to continue to pass through the assembly 10. As an alternative, a assembly 50 is provided in FIG. 8. Most components of the assembly 50 resemble those of the assembly 10 and have been numbered correspondingly. The primary difference between the assemblies 10 and 50 is that the sleeve 18 is replaced by a sleeve 52 having an extension 54. The groove 22 becomes blocked by the extension 54 when the sleeve 52 is actuated per the above description given for the sleeve 18, thereby enabling the assembly 50 to "catch" and retain a plug after actuation thereof. Thus, the assemblies 50 can be used, e.g., to enable isolation between neighboring production zones or the like. In order to enable production of hydrocarbons or the like, the plugs 16 that are caught and retained could be removed mechanically, such as by milling. Alternatively, the plugs could be formed from a material that is dissolvable, corrodible, consumable, degradable, etc. in response to a fluid available or deliverable downhole, such as plugs commercially available from Baker Hughes, Inc. under the tradename INTALLIC®.

It is to be appreciated that the track 38 could be alternatively arranged. For example, the track could extend circumferentially between two sleeves or other components (e.g., a counter sleeve/component and a tool sleeve/component) with the two differing directions being rotational, not axial. For example, recesses 22 could be modified so that they circumferentially taper radially outward, such that axial pressure exerted on the seat results in angular and radial displacement of the dogs along the tapers and into the recess for enabling the plug to pass therethrough. By abutting a counter sleeve against the dogs, the angular displacement of the dogs into the recesses will cause rotation of the counter sleeve, with a spring or biasing element rotationally returning the counter sleeve to its initial position. In such an embodiment, repeated back-and-forth rotation counter sleeve relative to the other component could similar to the above, incrementally progress a lock member along this modified circumferentially directed track, until the lock member reaches the end of the track, at which point the two components would become rotationally locked together for rotationally actuating a tool.

Figure 9:
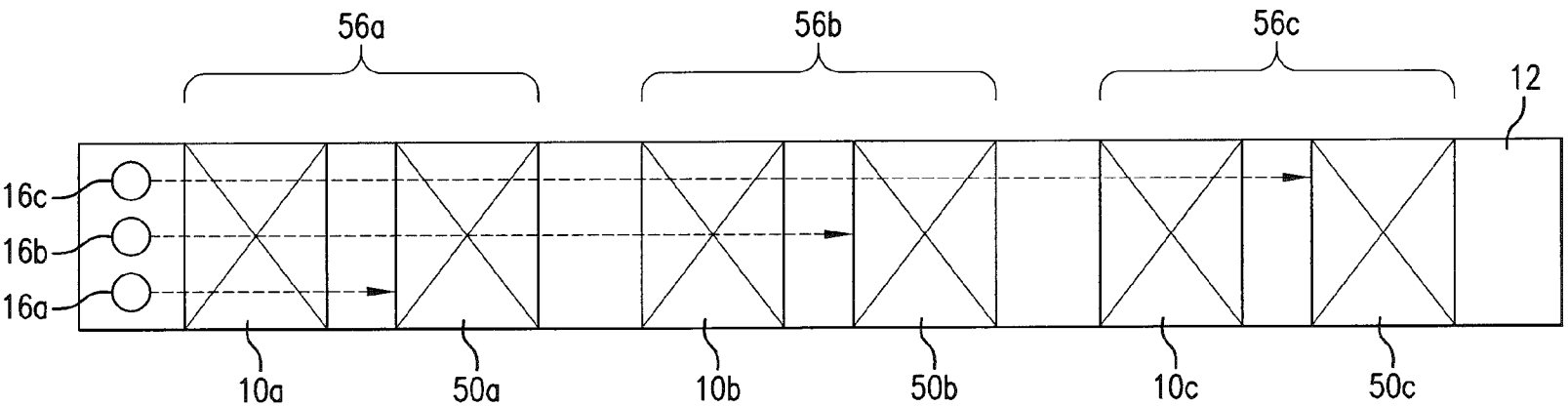
FIG. 9 is a schematic illustration of a plurality of groups of assemblies arranged in a tubular string, each assembly including at least one pass-through assembly and one plug-catch assembly.

It is to be understood that the sleeves 10 and 50 could be arranged in any combination. It is of course also to be understood that certain assemblies may need longer or shorter variations of the track 38 depending on the number of plugs which are required to pass through. To illustrate the use of multiple ones of the assemblies 10 and 50 together, an example is schematically presented in FIG. 9. Specifically, FIG. 9 depicts a system in which the tubular string 12 includes therein a plurality of groups 56*a*, 56*b*, and 56*c* that are each formed from one (or more) of the pass-through assemblies 10 (designated as the assemblies 10*a*, 10*b*, and 10*c* respectively) and a single one of the catch assemblies 50 (designated as the assemblies 50*a*, 50*b*, and 50*c*, respectively). The groups 56*a*, 56*b*, and 56*c* could correspond to different production zones, for example, with the assemblies 50*a*, 50*b*, and 50*c* enabling isolation therebetween for fracturing purposes. Although only one is shown in each group, any number of the pass-through assemblies 10 could be included in any group, with the pass-through assemblies 10 requiring only a single catch assembly 50 at the bottom of the group for enabling isolation.

In the example of FIG. 9, a first same-sized plug 16*c* is pumped down through each of the assemblies 10*a*, 50*a*, 10*b*, 50*b*, and 10*c* before being caught by the assembly 50*c*, a second same-sized plug 16*b* pumped down through each of the assemblies 10*a*, 50*a*, and 10*b* before being caught by the assembly 50*b*, and a third same-sized plug being pumped down through the assembly 10*a* before being caught by the assembly 50*a*. The assemblies 10*a* and 50*a* can be set to be actuated by the plug 16*a*, the assemblies 10*b* and 50*b* to be actuated by the plug 16*b*, and the assemblies 10*c* and 50*c* to be actuated by the plug 16*c*. That is, assuming there are 'n' number of groups of assemblies located downhole of the assembly 50*c* that need to be similarly actuated, then the counter mechanism of the assembly 50*c* can be set to actuate at 'n+1' plugs dropped (i.e., counting and passing 'n' plugs before being locked and actuating due to the next plug), the assembly 50*b* set to actuate at 'n+2' plugs dropped, and the assembly 50*a* set to actuate at 'n+3' plugs dropped, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A counter assembly comprising:

an actuatable component;

a counter component disposed with the actuatable component and initially in a first position relative the actuatable component and movable with respect to the actuatable component; and a lock member engaged in a track formed between the actuatable component and the counter component, the lock member operatively arranged for enabling relative movement between the actuatable component and the lock member in a first direction only and between the counter component and the lock member in a second direction only, the first direction differing from the second direction, at least one iteration of travel of the counter component to a second position relative the actuatable component and back to the first position progressing the lock member incrementally along the track, wherein the actuatable component is immovably locked to the counter component by the lock member when the lock member has reached an end of the track.

2. The assembly of claim 1, further including a seat coupled to the counter component, the seat operatively arranged for receiving a plug for impeding fluid flow through the seat.

3. The assembly of claim 2, wherein the seat is operatively arranged to move the counter component from the first position to the second position in response to a fluid pressure event when the plug is received at the seat.

4. The assembly of claim 3, wherein a biasing element is coupled to the counter component for returning the counter component to the first position.

5. The assembly of claim 3, wherein the seat is arranged to pass at least one of the plugs.

6. The assembly of claim 5, wherein movement of the counter position from the first position to the second position also aligns the seat with recess or groove for enabling radial expansion of the seat and passage therethrough of the plug.

7. The assembly of claim 5, wherein there are multiple plugs and each of the plugs has a same size.

8. The assembly of claim 5, wherein receiving and passing the at least one plugs corresponds to the at least one iteration of movement of the counter component.

9. The assembly of claim 5, wherein the lock member travels one unit along the track for each of the at least one iterations, and a number of the units is equal to a number of plugs that pass through the seat.

10. The assembly of claim 5, wherein the lock member reaches the end of the track after passing a designated number of plugs.

11. The assembly of claim 10, wherein receipt of an additional plug at the seat after passing the designated number of plugs results in actuation of the actuatable component due to the actuatable component being immovably locked to the counter component by the lock member.

12. The assembly of claim 11, wherein the seat is operatively arranged to pass the additional plug after actuation of the actuatable assembly.

13. The assembly of claim 11, wherein the seat is operatively arranged to retain the additional plug after actuation of the actuatable assembly.

14. The assembly of claim 13, wherein the actuatable member is coupled with an extension and movement of the actuatable member enables the extension to radially support the seat and prevent passage of the additional plug therethrough.

15. A system including at least one group of assemblies disposed in a tubular string, each of the assemblies according to claim 11.

16. The system of claim 15, wherein at least one of the assemblies in each of the at least one groups is operatively arranged to pass the additional plug after actuation of the actuatable assembly and exactly one of the assemblies in each group is arranged to retain the additional plug after actuation of the actuatable assembly.

17. The assembly of claim 1, wherein the actuatable component and the counter component comprise sleeves.

18. The assembly of claim 1, wherein the seat comprises one or more dogs.

19. The assembly of claim 1, wherein the lock member comprises at least a portion of a ring.

20. The assembly of claim 1, wherein the relative movement in the first and second directions is enabled by complementarily formed ratcheting on opposite sides of the lock member and the actuatable component and the counter component, respectively.

21. The assembly of claim 1, further comprising a release member for initially holding the actuatable component in a non-actuated position.

22. The assembly of claim 1, further comprising a lock element operatively arranged for engaging the actuatable component when the actuatable component is moved to an actuated position and holding the actuatable component in an actuated position.

23. The assembly of claim 1, wherein actuation of the actuatable component enables one or more ports to be opened.

* * * * *